US006226805B1

(12) United States Patent
Watkins

(10) Patent No.: US 6,226,805 B1
(45) Date of Patent: May 8, 2001

(54) SIDE BOLT TOILET LID LOCKING SYSTEM

(76) Inventor: Timothy Joseph Watkins, P.O. Box 11281, Glendale, AZ (US) 85318

( * ) Notice: Subject to any disclaimer, the term of this patent is extended or adjusted under 35 U.S.C. 154(b) by 0 days.

(21) Appl. No.: 09/539,340

(22) Filed: Mar. 31, 2000

(51) Int. Cl.[7] ..... A47K 13/24
(52) U.S. Cl. ..... 4/253
(58) Field of Search ..... 4/253; 292/32, 292/35, 41

(56) References Cited

U.S. PATENT DOCUMENTS

| | | | |
|---|---|---|---|
| 4,145,771 | 3/1979 | Khazin | 4/253 |
| 4,296,504 | 10/1981 | Lawson | 4/253 |
| 4,395,784 | 8/1983 | Foster | 4/236 |
| 4,507,813 | 4/1985 | Lawson | 4/253 |
| 4,524,470 | 6/1985 | Grenell | 4/253 |
| 4,561,130 * | 12/1985 | Bumgardner et al. | 4/253 |
| 4,575,879 * | 3/1986 | Cabral et al. | 4/253 |
| 4,724,551 | 2/1988 | Gardner | 4/253 |
| 5,003,641 | 4/1991 | Selman | 4/253 |
| 5,347,663 | 9/1994 | Yost | 4/253 |
| 5,669,081 | 9/1997 | Scherer et al. | 4/253 |

FOREIGN PATENT DOCUMENTS

| | | | |
|---|---|---|---|
| 2256206 * | 12/1992 | (GB) | 4/253 |

* cited by examiner

*Primary Examiner*—Charles E. Phillips

(57) ABSTRACT

A manufactured article comprising a upper lid attachment piece (50), protruding member (12), housing unit (22), forward assist springs (40), slide-bolt (18) and handle (20) which is disposed on a toilet bowl, toilet lid and hinge connection points utilizing existing holes and fasteners whereby the user pulls a handle to the rear then lifts the toilet lid to gain access and closes the lid to automatically engage the system, thereby denying access of small children into the toilet bowl.

4 Claims, 4 Drawing Sheets

SIDE BOLT TOILET LID LOCKING SYSTEM

BACKGROUND—FIELD OF INVENTION

The present invention relates to toilet bowl lids, and more particularly to the locking of toilet bowl lids to prevent small children from gaining access.

BACKGROUND—DESCRIPTION OF PRIOR ART

The use of locking devices for toilet lids and seats is known prior art. More specifically, lid and seat locking methods previously devised and utilized are known to consist basically of familiar, expected and obvious structural configurations, not withstanding the myriad of designs encompassed by crowded prior art which has been developed for the fulfillment of countless objectives and requirements.

The present invention is directed to improving devices for denying access of small children into toilet bowls in a manner which is safe, secure, economical and aesthetically pleasing.

For example, U.S. Pat. No. 4,507,813 to Lawson (1985) describes an automatically engagable locking device consisting of a single mounting bar attached to the underside of the lid that carries a pivoted, spring-biased locking arm which is released by simple finger pressure and returns to a positive locking position automatically.

U.S. Pat. No. 4,724,551 to Gardner (1986) describes a lid lock comprising a hinge arm connected to the toilet lid, a locking base connected to the hinge arm, and a locking handle pivotally connected to the locking bar.

U.S. Pat. No. 4,524,470 to Grenell (1984) describes a lock mechanism normally restraining manual raising movement of a toilet lid; a lid control shoe has an outer portion adapted for attachment to a lid upper surface and a shelf portion projecting toward a toilet apron surface.

U.S. Pat. No. 5,347,663 to Yost (1993) describes a device with a lock bolt attached to the rear of a toilet lid that has a bolt that rests on top of a toilet lid to deny access.

U.S. Pat. No. 5,003,641 to Selman (1990) describes a gravity reset mechanism having a pivotable locking arm extending over a toilet lid and is affixed to a housing containing interlocking parts which permit locking and unlocking of the device.

U.S. Pat. No. 5,669,081 Schener, Brown, and Thuma (1996) describes a device that is mountable to the rim portion of the bowl where the housing includes at least one lock receiving element therein.

U.S. Pat. No. 4,145,771 to Khazin (1978) describes a flat locking strap that is secured at one end to the top of a toilet lid and to the toilet bowl with a means to disengage the strap.

U.S. Pat. No. 4,395,784 to Camp (1981) describes a rectangular-shaped lock block with its forked interface hinge that is joined by a common axle which also serves to hold the interface hinge firmly against the toilet seat to deny access.

U.S. Pat. No. 4,296,504 to Lawson (1980) describes a device for use with a toilet seat including a lever adapted to fit through a hole in the toilet seat cover so as to allow rotation of the lever when the toilet seat cover is in the horizontal position.

None of the inventions disclosed above provide an adequate means that is durable, inexpensive, provides ease of operation, is aesthetically pleasing, requires a minimum number of parts, is removable, and easy to produce and install.

In this respect, the Slide Bolt Toilet Lid Locking System according to the present invention substantially decreases the conventional concepts and designs of prior inventions, and in doing so provides a safe, durable, and reusable apparatus primarily developed for the purpose of denying access of small children into toilet bowls.

The present invention achieves its intended objects and advantages through a new, useful, unobvious combination of methods, steps, and components that use a minimum number of functional parts which can be manufactured at a reasonable cost with readily available materials.

OBJECTS AND ADVANTAGES

Accordingly, besides the objects and advantages of the invention's process to deny access of small children into toilet bowls described in the current invention, several additional objects and advantages of this invention are:

a) Provide an improved apparatus for locking toilet lids which may be manufactured easily and efficiently.

b) Provide components that adjust to accommodate various size toilets, seats, and lids.

c) Provide a method to deny access into a toilet bowl, which provides in the apparati and methods of the prior art some of the advantages thereof while simultaneously overcoming some of the disadvantages normally associated therewith.

d) Provide a method for adults or older children to disengage the system quickly.

Still yet another object of the present invention is to:

a) Provide a toilet lid locking method which will allow its removal and reuse.

b) Can be made or painted any color to match existing decor which make it aesthetically pleasing.

c) Provide a toilet lid locking system that may be universally applied to a wide variety of different toilets thereby precluding the need to manufacture or inventory a large number of different toilet lid locking methods.

d) Provide a locking toilet lid method that can be installed in existing holes easily.

e) Provide a locking toilet lid method that can be cleaned and disinfected easily.

The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure.

Therefore, it can be appreciated that there exists a continuing need for a locking toilet lid system which can be used to deny small children access into a toilet bowl. In this, the present invention substantially fills this need.

As illustrated by the background art, efforts are obviously being made in an attempt to develop devices for denying access of children into toilet bowls. No prior effort, however, provides the benefits apparent with the present inventions. Additionally, the prior art and commercial techniques do not suggest the inventive combination of component elements and features configured as disclosed and claimed herein.

Still further objects and advantages will become apparent from a consideration of ensuing description and drawings.

DRAWING FIGURES

Figure 1:
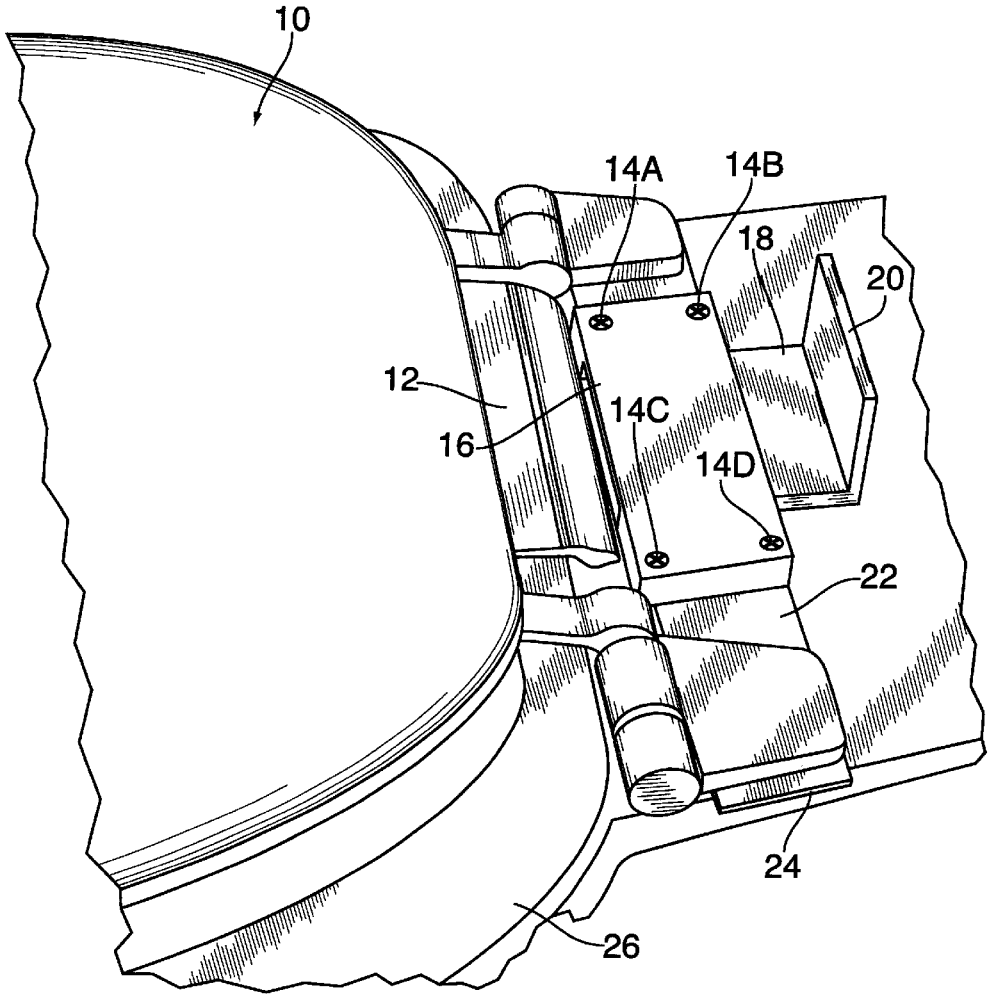
FIG. 1 is a perspective view of the first embodiment of the present invention illustrating its manner of use.
Figure 2:
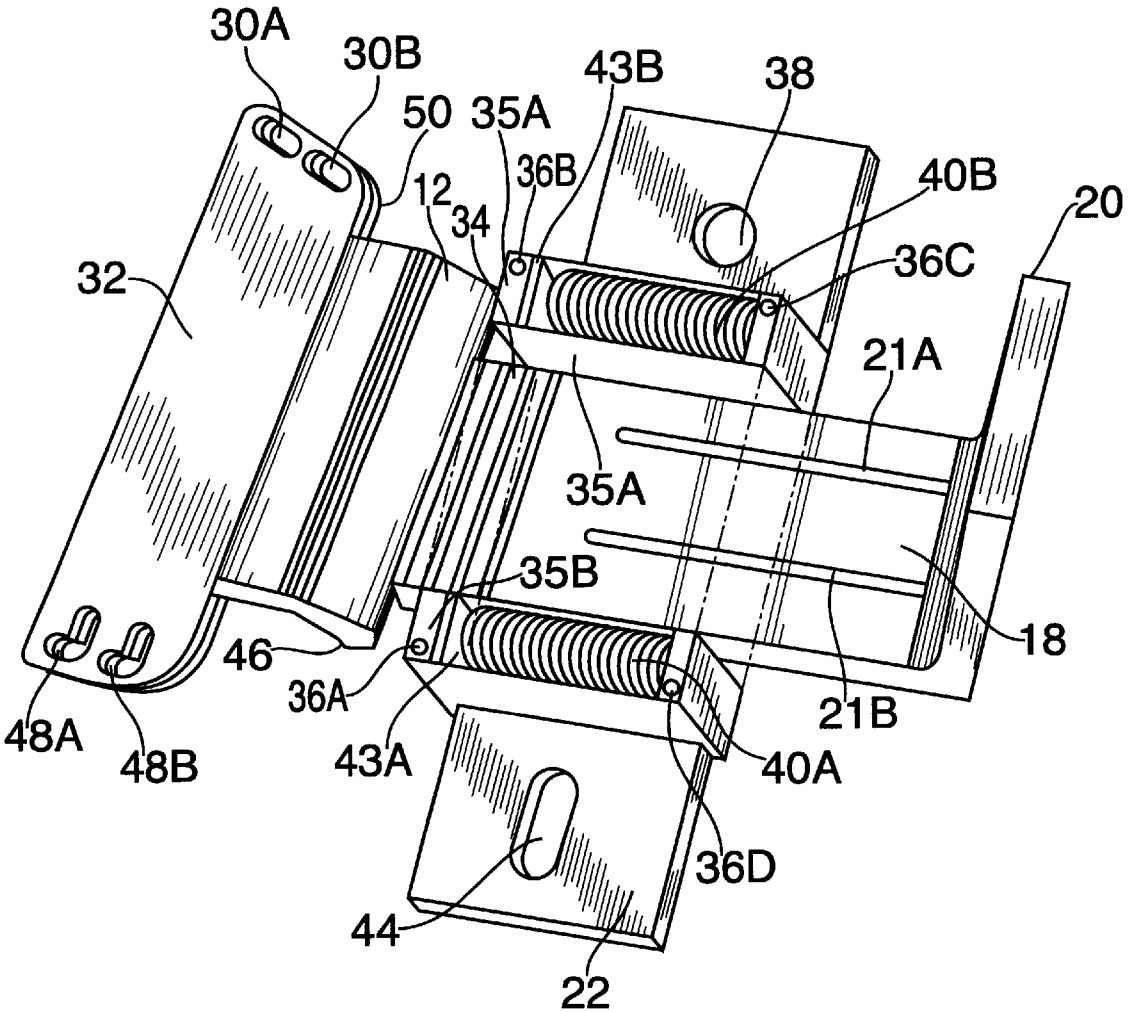
FIG. 2 is a perspective view illustrating its manner of construction.
Figure 3:
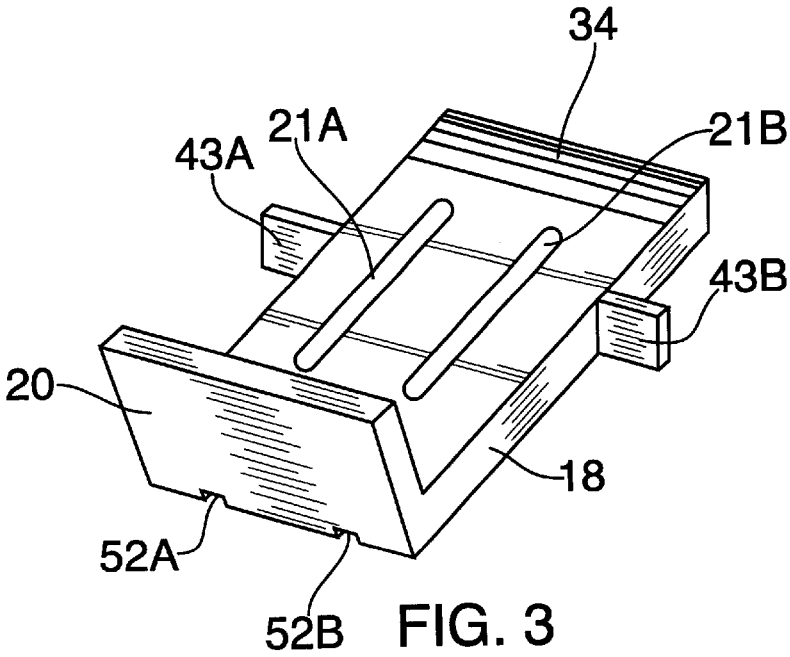
FIG. 3 is a perspective view illustrating the slide bolt's manner of construction.
Figure 4:
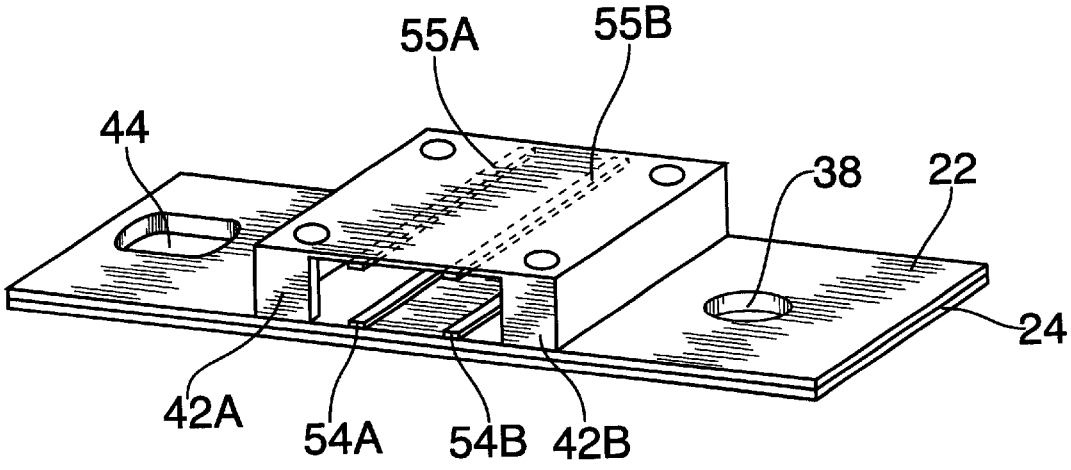
FIG. 4 is a perspective view illustrating the bowl attachment piece's manner of construction.
Figure 5:
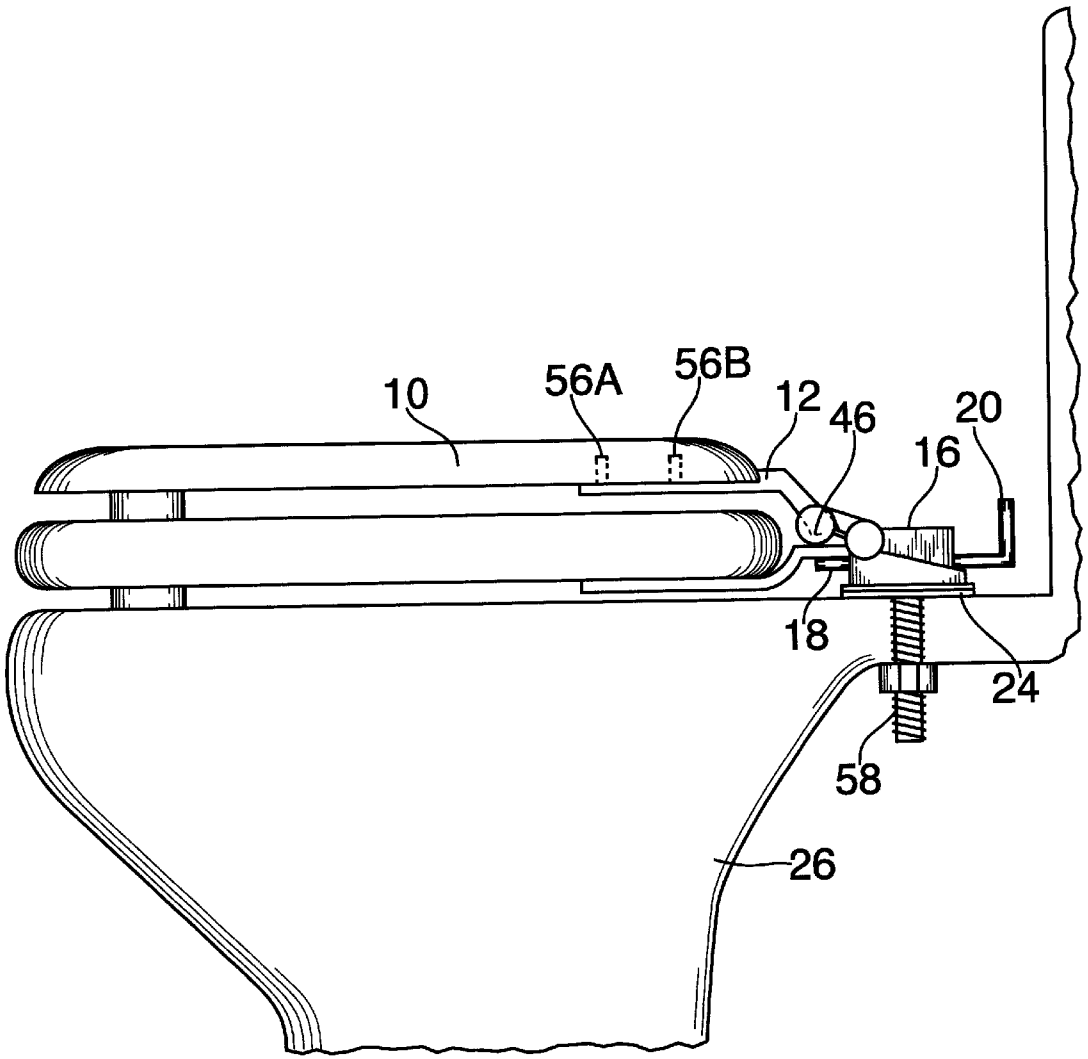
FIG. 5 is a isometric view illustrating the placement of the current invention.

| Reference Numerals in Drawings | |
|---|---|
| 10 | Toilet Lid |
| 12 | Wedge |
| 14A–D | Screws |
| 16 | Cover Plate |
| 18 | Slide Bolt |
| 20 | Handle |
| 21A | Slide Bolt Upper Groove |
| 21B | Slide Bolt Upper Groove |
| 22 | Bowl Attachment Frame |
| 24 | Gasket |
| 26 | Bowl |
| 28 | Toilet Seat |
| 30A | Oblong Hole |
| 30B | Oblong Hole |
| 32 | Gasket |
| 34 | Grooves |
| 35A | Arrest plate |
| 35B | Arrest plate |
| 36A–D | Cover Plate Screw Points |
| 38 | Bowl & Hinge Screw Point |
| 40A | Forward Assist Spring |
| 40B | Forward Assist Spring |
| 42A | Back Plate |
| 42B | Back Plate |
| 43A | Push Plate |
| 43B | Push Plate |
| 44 | Oblong Screw Point |
| 46 | Grooves |
| 48A | Curved Screw Point |
| 48B | Curved Screw Point |
| 50 | Lid Attachment Piece |
| 52A | Bolt Slide Groove |
| 52B | Bolt Slide Groove |
| 54A | Attachment Piece Groove |
| 54B | Attachment Piece Groove |
| 55A | Upper Slide Groove |
| 55B | Upper Slide Groove |
| 56A–B | Attachment Piece Screw Points |
| 58 | Plastic Screw |

SUMMARY

In accordance with the present invention, a Slid Bolt Toilet Lid Locking System comprises a bowl attachment frame, slide bolt, wedge and forward assist springs that attach to a toilet bowl at the hinge connection point in existing holes, that is moved forward to engage and reversed to disengage the system.

Description FIGS. 1 to 5

A typical embodiment of the current invention is illustrated in FIG. 1. The current invention has a frame (22) and all other parts with the exception of the springs constructed of Polysteel (™) as the preferred material, disposed on a toilet bowl (26) with a gasket (24) disposed therebetween and attached with existing fasteners through the round hole (38) and the oblong hole (44) to allow for toilet bowl mounting areas of differing sizes.

The current invention has a cover plate (16) for the purpose of covering the slide bolt (18), guiding the slide bolt with grooves (55A–B) and to cover the forward assist springs (40A–B). The purpose of the forward assist springs (40A–B) is to move the slide bolt forward to cause a bind with the wedge (12). The slide bolt (18) is disposed inside of the bowl attachment frame (22) and is guided by the slide bolt upper grooves (21A–B) and grooves (55A–B) on the bottom of the cover plate (16).

The forward assist springs (40A–B) back up to back plates (42A–B). The forward direction of the slide bolt is arrested by arrest plates (43A–B) thereby allowing the slide bolt limited movement to cause a bind with the wedge (12) and movement to the rear to disengage the bind.

The slide bolt (18) has grooves (34) on the top side of its binding end to prevent slippage and allow traction when the toilet lid (10) is closed, thereby allowing the grooves (46) on the wedge to make enough contact to force the slide bolt in a rearward direction allowing the current invention to engage. The wedge (12) is connected to the lid attachment piece (50), which is mounted to a toilet bowl lid (10) by placement of a gasket (32) utilizing existing holes (56A–B) and fasteners.

There are oblong holes (30A–B) and curved holes (48A–B) to allow the lid attachment piece to align on toilet lids of differing sizes.

The cover plate (16) is attached to the bowl attachment frame (22) by inserting screws (14A–D) in screw holes (36A–D).

The handle (20) is made part of or attached to the extreme end of the slide bolt (18).

This current invention can be colored by pigmenting the poly steel or painted during the manufacturing process. This current invention may be cleaned with common household cleaners. From the description above, a number of advantages of this invention become evident.

A) Provides a durable, inexpensive means to secure a toilet bowl lid.

B) Will adjust to fit most toilet bowls seat and lid assemblies.

C) Provides an improved locking toilet lid system which has all the advantages of the prior art and none of the disadvantages.

D) Provides a system that is clean, sanitary and doesn't require the user to make contact with areas that come in contact with human waste.

E) Can be manufactured and marketed easily and efficiently.

F) The entire invention with the exception of the springs can be made using a injection mold machine.

Operation—FIGS. 1,2,3,4,5

The manner of using the Slide Bolt Toilet Lid Locking System is to remove the plastic screws 58 from the toilet seat and lid hinge connection point. The bowl attachment frame (22) is then aligned on the toilet bowl and gasket (24) is placed therebetween. The existing screws are then reinserted through the hinge mounting point and tightened.

The toilet lid (10) is then removed and gasket (32) is then placed underneath the toilet and aligned with existing holes, whereby the lid attachment piece (50) is then disposed on the gasket and existing screws are then reinserted and tightened.

The forward assist springs (40A–B) are disposed in the bowl attachment frame (22) by placing the slide bolt (18) in position to align grooves (21A–B) (52A–B) (54A–B) (55A–B) and moving the slide bolt (18) in a rearward direction and placing the springs in position behind push plates (43A–B).

The cover plate (16) is then attached by screws (14A–D) into screw points (36A–D). To operate the Slide Bolt Toilet Lid Locking System, the user must pull the handle (20)

towards the toilet tank and then lift the toilet lid. To engage the system, the user must close the toilet bowl lid, thereby allowing the grooves (46) located on the wedge (12) to push the slide bolts grooves (34) towards the toilet tank automatically engaging the system. There is space of about 1/32 of an inch space between the upper lid piece and the slide bolt to allow the slide bolts grooves enough clearance to perform this operation without binding. A small child cannot pull the handle and then open the lid.

Summary, Ramification and Scope

Accordingly, the reader will see that the Slide Bolt Toilet Lid Locking System can be used inexpensively and conveniently to lock and secure a toilet bowl lid and deny access to small children.

As to the manner of usage and operation of the present invention, the same should be apparent from the above description, Accordingly, no further discussion relating to the manner of usage and operation will be provided.

With respect to the above description, then it is to be realized that optimum dimensional relationships for the parts of the invention, to include variations in size, materials, shape, form, fit, function, and manner of operation, assembly and usage, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention further, since numerous modification will readily occur to those skilled in the art, it is not desired to limit the invention to exact connection and orientation shown and described, and accordingly, all suitable modification and equivalents may be resorted to, falling within the scope of the invention. In as much as the present disclosure includes all contained in the appended claims as well as that of the foregoing description, and although this invention has been described in its preferred forms with certain degree of particularity, it is understood that the present disclosure of the preferred form has been made only by way of example and numerous changes in details of construction and combination and arrangement of parts may be resorted to without departing from the spirit and scope of the invention.

Thus the scope of this invention should be determined by the appended claims and their legal equivalents, rather by examples given.

What is claimed is:

1. A toilet lid securing system comprising:

a toilet lid attachment piece having a portion for mounting to the underside of a toilet lid and a wedge portion extending beyond said lid in the direction of the lid hinge with said attachment so mounted;

a slid bolt assembly comprising a mounting plate capable of mounting said assembly to the toilet bowl via the toilet seat/lid mounting bolts, a slide bolt being spring biased toward said portion extending beyond said lid for contact therewith so as to prevent pivoting of said lid by a child; a handle mounted on said slide bolt for use in manually overcoming said spring bias so as to allow pivoting of said lid.

2. The system of claim 1 wherein said wedge portion is disposed on the bottom side of the said lid attachment piece extending downward at about a 60 degree angle towards a toilet bowl.

3. The system of claim 1 including a housing unit for said slide bolt assembly wherein one generally circular hole is provide and one generally oblong hole is provided to allow for adjustment of various size bowls, whereby toilet lid/seat mounting brackets are disposed on the top side of the said housing unit and existing fasteners are inserted therethrough and tightened.

4. The system of claim 3 wherein the slide bolt is disposed slidably inside the said housing unit wherein a vertical push plate is disposed on each side thereof disposed in a manner to allow movement forward and reverse against the bias of springs within the said housing.

* * * * *